US005676877A

United States Patent [19]

Borduz et al.

[11] Patent Number: 5,676,877

[45] Date of Patent: Oct. 14, 1997

[54] PROCESS FOR PRODUCING A MAGNETIC FLUID AND COMPOSITION THEREFOR

[75] Inventors: Stefan Borduz, Milford; Lucian Borduz, Northwood, both of N.H.; Shiro Tsuda, Chiba, Japan

[73] Assignee: Ferrotec Corporation, Tokyo, Japan

[21] Appl. No.: 622,315

[22] Filed: Mar. 26, 1996

[51] Int. Cl.[6] ..... H01F 1/28

[52] U.S. Cl. ..... 252/62.52; 252/62.54

[58] Field of Search ..... 252/62.52, 62.54

[56] References Cited

U.S. PATENT DOCUMENTS

| | | | |
|---|---|---|---|
| 3,215,572 | 11/1965 | Papell | 252/62.52 |
| 3,531,413 | 9/1970 | Rosenweig | 252/62.62 |
| 3,700,595 | 10/1972 | Kaiser | 252/62.56 |
| 3,917,538 | 11/1975 | Rosenweig | 252/62.51 |
| 4,280,918 | 7/1981 | Homola et al. | 252/62.51 |
| 4,315,827 | 2/1982 | Bottenberg et al. | 252/62.51 |
| 4,356,098 | 10/1982 | Chagnon | 252/62.51 |
| 4,430,239 | 2/1984 | Wyman | 252/62.51 |
| 4,554,088 | 11/1985 | Whitehead et al. | 252/62.54 |
| 4,576,725 | 3/1986 | Miura et al. | 252/62.51 |
| 4,599,184 | 7/1986 | Nakatani et al. | 252/62.51 |
| 4,604,222 | 8/1986 | Boruz et al. | 252/62.52 |
| 4,608,186 | 8/1986 | Wakayama et al. | 252/62.52 |
| 4,624,797 | 11/1986 | Wakayama et al. | 252/62.52 |
| 4,687,596 | 8/1987 | Borduz et al. | 252/62.51 |
| 4,938,886 | 7/1990 | Lindsten et al. | 252/62.51 |
| 5,013,471 | 5/1991 | Ogawa | 252/62.52 |
| 5,064,550 | 11/1991 | Wyman | 252/62.52 |
| 5,085,789 | 2/1992 | Yokouchi et al. | 252/62.52 |
| 5,124,060 | 6/1992 | Yokouchi et al. | 252/62.51 |
| 5,143,637 | 9/1992 | Yokouchi et al. | 252/62.52 |
| 5,147,573 | 9/1992 | Chagnon | 252/62.52 |
| 5,240,628 | 8/1993 | Kanno | 252/62.56 |

*Primary Examiner*—Melissa Bonner
*Attorney, Agent, or Firm*—Davis and Bujold

[57] ABSTRACT

The invention relates to a composition and a process for producing a chemically stable magnetic fluid comprising finely divided magnetic particles covered with surfactants. A surface modifier is also employed which is added to cover thoroughly the free oxidizable exterior surface of the outer layer of the particles to assure better chemical stability of the colloid under different environmental conditions.

8 Claims, 1 Drawing Sheet

PROCESS FOR PRODUCING A MAGNETIC FLUID AND COMPOSITION THEREFOR

BACKGROUND OF THE INVENTION

Magnetic fluids used in technical applications, commonly referred to as ferrofluids, are a dispersion of finely divided magnetic or magnetizable particles ranging between thirty (30) and one hundred fifty (150) angstroms in size and dispersed in a liquid carrier.

The magnetic particles are typically covered with surfactants or a dispersing agent. The majority of industrial applications using magnetic fluids incorporate iron oxides as magnetic particles. The most suitable iron oxides, for magnetic fluid applications, are ferrites such as magnetite ($Fe_3O_4$) or ferric oxides ($Fe_2O_3$) such as gamma. Ferrites and ferric oxides offer a number of physical and chemical properties to the magnetic fluid, the most important of these being saturation magnetization, viscosity, magnetic stability, and chemical stability of the whole system. The amount of magnetic particles in the magnetic fluid composition can range up to 40% by volume.

The surfactants have two major functions. The first is to assure a permanent distance between the magnetic particles to overcome the forces of attraction caused by Van der Waal's force and magnetic interaction, and the second is to provide a chemical composition on the outer layer of the covered particle which is compatible with the liquid carrier and the chemicals in the surrounding environment. Most of the magnetic fluids employed today have one (1) to three (3) types of surfactants arranged in one (1), two (2) or three (3) layers around the magnetic particles. The surfactants, for magnetic fluids, are long chain molecules having a chain length of at least sixteen (16) atoms such as carbon, or a chain of carbon and oxygen, and a functional end group at one end. The functional end group can be of a cationic, an anionic or a nonionic nature. The functional end group is attached to the outer layer of oxides (magnetic particles) by either chemical bonding or physical force or a combination of both, and the chain or tail of the surfactant provides a permanent distance between the particles and compatibility with the liquid carrier. For all practical purposes, the amount of surfactant in the magnetic fluid composition can range up to thirty (30)% by volume.

The carrier is generally an organic molecule, either polar or non polar, of various chemical composition such as hydrocarbon (polyalpha olefins, aromatic chain structure molecules), esters (polyol esters), silicone, or fluorinated and other exotic molecules with a molecular weight range up to five thousand (5,000).

There are several physical and chemical properties of the magnetic fluid related to the type of carrier such as viscosity, evaporation rate, resistance and compatibility with the surrounding environment.

There are many patents related to the preparation of magnetic fluids and the most relevant of which for this invention are:

U.S. Pat. No. 3,531,413 describes a process where magnetic particles are initially dispersed in a non-polar solvent, and then flocculated with a polar solvent whereby the particles are separated from the initial solvent and resuspended in a different solvent.

U.S. Pat. No. 3,917,538 describes a process which consists of grinding coarse magnetic particles in an aqueous carrier using a dispersing agent. The aqueous ferrofluid obtained from the grinding process is flocculated and the magnetic particles are separated out of the aqueous solution. The particles are then washed, dried and resuspended in an organic carrier using a second dispersant.

U.S. Pat. No. 3,700,595 describes using a carboxylic acid having at least a twelve (12) carbon chain as a surfactant which is oil soluble and water insoluble, or a high molecular weight polyisobutene carboxylic acid surfactant.

U.S. Pat. No. 4,280,918 describes a process for preparation of a magnetic dispersion for use in magnetic coating. The magnetic particles are coated with a uniform material, preferably colloidal silica. The coating prevents aggregation of magnetic particles. The pH of the slurry is adjusted to between three (3) and six (6), by an acid, to produce a positive electrostatic charge on the magnetic particles and to mix a colloidal silica having a negative electrostatic charge. The two oppositely charged particles are attracted to and the silica particles are irreversibly bonded to the magnetic particles.

U.S. Pat. No. 4,315,827 describes a method of preparing a stable ferrofluid composition by dispersing magnetic particles in polyphenyl ether using surfactants with one functional polar group reactive with the surface of the particles, and a tail group containing phenyl, benzyl or phenoxy groups soluble in the liquid carrier.

U.S. Pat. No. 4,356,098 describes a method of preparing a stable silicone oil ferrofluid composition which comprises a colloidal dispersion of finely divided magnetic particles in a liquid silicone oil carrier, a dispersing amount of silicone oil surfactants containing a functional group which forms a chemical bond with the surface of magnetic particles, and a tail group which is soluble in the silicone oil carrier to provide a stable magnetic composition. The tail group of the surfactant has a number of atoms of silicon and oxygen chains, or siloxane, in order to be soluble in the silicone oil.

U.S. Pat. No. 4,430,239 describes a stable ferrofluid composition comprising a colloidal dispersion of finely divided magnetic particles in a liquid carrier, and a dispersing amount of a dispersing agent, which agent comprises an acid phosphoric acid ester of a long chain alcohol, the long chain alcohol being compatible with the polar liquid carrier.

U.S. Pat. No. 4,576,725 describes a method of preparing a magnetic fluid by dispersing metallic magnetic particles, having an average diameter of several hundreds of angstroms, in a base liquid. The particles are obtained by condensation of metallic vapor in the liquid carrier. The metal magnetic particles in the ferrofluid are oxidized very rapidly. The oxidation process of the metallic particles will dramatically change the initial property of the ferrofluid.

U.S. Pat. No. 4,599,184 describes an attempt to improve the oxidation and magnetic stability of the magnetic metal particles obtained from metallic vapor condensation by coating the particles with a surface active agent or surfactant. In order to obtain a stable magnetic fluid, the particles have to be covered with a surfactant as in any other process, to obtain a stable magnetic fluid.

U.S. Pat. Nos. 4,604,229 and 4,687,596 describe methods for producing stable electrically conductible magnetic fluids using cationic high molecular weight surfactants and polar carriers.

U.S. Pat. No. 4,608,186 describes a magnetic fluid comprising fine metal particles of cobalt, and a surface active agent selected from a group consisting of polyglycerime fatty acid esters, sorbitan fatty acid esters and a mixture thereof. The liquid carrier is a hydrocarbon. The composition contains tocopherol as an antioxidant additive.

U.S. Pat. No. 4,624,797 describes a magnetic fluid comprising fine particles of cobalt, and a surface active agent selected from the group consisting of oil soluble anionic sulfosuccinate and nonionic poly-glycerine fatty acid ester or the group consisting of polyethyleneglycol alkyl ether and a low volatility solvent medium.

Metallic magnetic particles of a diameter less than two hundred (200) angstroms and evenly coated with a surfactant are highly unstable and oxidized very rapidly. Today, there are no commercial applications of such fluid using magnetizable metal particles. The major drawback of this process is the oxidation of the magnetic particles.

U.S. Pat. No. 4,938,886 describes a super paramagnetic fluid comprising magnetic particles; a dispersing agent of a formula A—X—B anchored to the magnetic particles, wherein A is derived from a nonionic surface active agent precursor having a terminal OH group, the precursor being selected from a group consisting of ethoxylated or propoxylated alcohols and other ethoxylated compounds, B is a carboxylic acid group which anchors the dispersing agent to the magnetic particles and X is a connecting group between A and B; and a carrier liquid which is a thermodynamically good solvent for A.

U.S. Pat. No. 5,013,471 describes a magnetic fluid where the particles are covered with a chlorosilane surfactant having a chain with ten (10) to twenty-five (25) atoms of carbon. Fluorine atoms are substituted for the hydrogen atoms of the hydrocarbon chain of the chlorosilane surfactant and fluorinated oil is used as a carrier. There is no other surfactant used in this process. According to this reference, the surfactant chlorosilane has to be large enough to disperse the particles and to assure the colloidal stability of the magnetic fluid by providing sufficient distance between the particles.

One object of the present invention is to use a silane surface modifier of very low molecular weight, e.g. one (1) to ten (10) carbon atoms, in the tail chain to be able to penetrate between the existing surfactant to cover the free (exposed) surface which is not covered by the large molecular weight surfactant. According to the present invention the silane can not be used to disperse the magnetic particle alone.

U.S. Pat. No. 5,064,550 describes a super paramagnetic fluid which is a stable colloid comprising a non-polar hydrocarbon carrier, and the magnetic particles are coated with at least one acid selected from the group consisting of an organic acid containing only carbon and hydrogen atoms in the chain connected to the carboxyl group where the chain contains at least nineteen (19) carbon atoms and an amino acid acylated with the fatty acid, wherein the organic and amino acids are branched, unsaturated or both, and an ashless polymer is provided to increase the viscosity of the super paramagnetic fluid.

U.S. Pat. No. 5,085,789 describes a ferrofluid composition consisting essentially of fine particles of ferromagnetic particles with alkylnaphtalene being used as the carrier and a surfactant with the hydrophobic portion consisting of alkylnaphtalene structure.

U.S. Pat. No. 5,124,060 describes a ferrofluid composition consisting essentially of an organic solvent carrier, ferromagnetic particles coated with oleophilic groups exhibiting an affinity for said organic solvent, and a fluorocarbon surface active material.

U.S. Pat. No. 5,143,637 describes a magnetic fluid consisting of ferromagnetic particles dispersed in an organic solvent, a low molecular weight dispersing agent, and an additive with a carbon number between twenty-five (25) and fifteen hundred (1,500). The low molecular weight dispersing agent is used to disperse the particles in an organic carrier. In the summary of this reference there is a discussion about using a coupling agent, such as silane, as a dispersant. However, the coupling agent has to have a large enough molecular weight to perform as a dispersant. It should be mentioned that, in U.S. Pat. No. 5,143,637, there is no particular disclosure claim directed to using silane as an additive or even as a dispersant. The thermal stability of the fluid is increased by adding a high molecular weight additive, e.g. up to twenty thousand (20,000), such as polystyrene, polypropylene, polybutene, or polybutadiene polymers.

U.S. Pat. No. 5,147,573 describes a method of preparing a colloidal dispersion of electrically conductive magnetic particles consisting essentially of superparamagnetic particles, an electrically conductive organo metallic compound, a dispersing agent comprising a nonionic, an anionic or a cationic surfactant, and a hydrocarbon organic solvent.

U.S. Pat. No. 4,554,088 employs polymeric silane as a coupling agent. The coupling agents are a special type of surface active chemicals which have functional groups at both ends of the long chain molecules. One end of the molecule is attached to the outer oxide layer of the magnetic particles and the other end of the molecule is attached to a specific compound of interest in those applications, such as drugs, antibody, enzymes, etc.

U.S. Pat. No. 5,240,628 describes a process for producing a magnetic fluid, which comprises adding a solution of N-polyalkylenepolyamine-substituted alkenylsuccinimide in a water-insoluble or water-sparingly-soluble organic solvent to an aqueous suspension of fine particles of ferrites and stirring the resulting mixture, thereby forming an emulsion and absorbing the N-polyalkylenepolyamine-substituted alkenylsuccinimide onto the fine particles of ferrites, then distilling off water and the organic solvent therefrom and dispersing the fine particles of N-polyalkylenepolyamine-substituted alkenylsuccinimide-absorbed ferrites in a base oil of low vapor pressure having a vapor pressure of not more than 0.1 mm Hg at 25° C.

In none of the above discussed patents is there an attempt to cover the surface area of the magnetic particles which is not already covered by the large size surfactants.

SUMMARY OF THE INVENTION

The present invention concerns a chemically stable magnetic fluid composition and a process of preparing such a composition.

A magnetic fluid has to exhibit stability in two areas in order to be used in current industrial applications. The first is to have magnetic stability under a very high magnetic field gradient since the magnetic particles tend to agglomerate and aggregate under high magnetic field gradients and separate out from the rest of the colloid. The second is to have chemical stability relating to oxidation of the surfactant and the organic oil carrier. All the organic oils undergo a slow or rapid oxidation process, over the course of time, which increases with temperature and the concentration of the oxygen in the surrounding environment in contact with the oil. This oxidation process results in an increased viscosity of the oil to the point where the oil becomes a gel or solid. There is also a different mechanism where the molecules break down and evaporate out of the system more quickly. This is the most important condition to assure a chemically stable colloid which is exposed to oxygen and high temperature.

BRIEF DESCRIPTION OF THE DRAWINGS

The invention will now be described, by way of example, with reference to the accompanying drawing in which.

DESCRIPTION OF THE PREFERRED EMBODIMENTS

Figure 1:
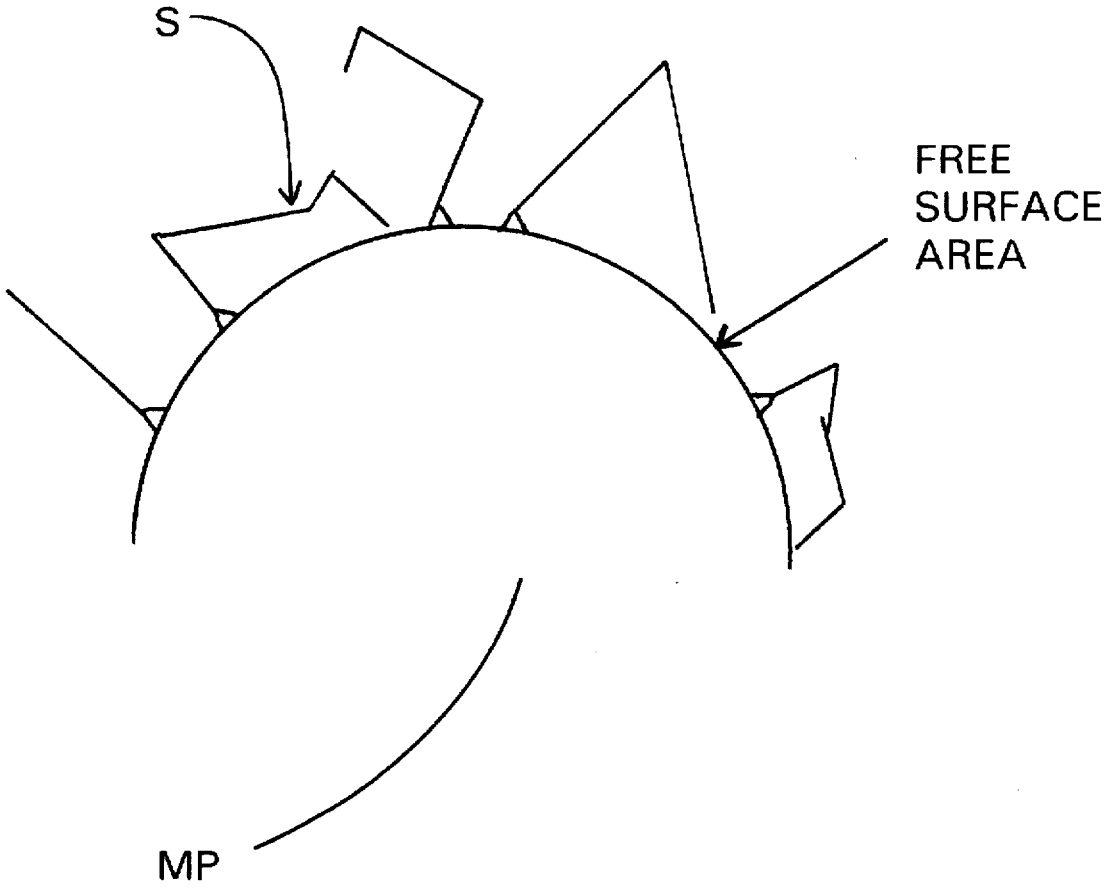
FIG. 1 shows a magnetic particle with a long tail surfactant attached thereto.

A long tail surfactant (S) will have the arrangements on the magnetic particles (MP) as can be seen in FIG. 1. A long tail surfactant, however, can not completely cover the entire outer oxidizable surface of the magnetic particles.

Repeated experiments show that an organic oil undergoes a faster oxidation in contact with a solid surface, especially oxides. The life of the oil is significantly reduced by mixing the oil with very small size magnetic particles. A simple calculation shows that a cubic centimeter of magnetic fluid of two hundred (200) gauss saturation magnetization has around ten (10) to power sixteen (16) number of magnetic particles of one hundred (100) angstrom diameter. This number of particles will provide approximately thirty (30) square meters of oxidizable outer area surface per cubic centimeter of magnetic fluid or per approximately 0.7 cubic centimeter volume of oil (about 0.55 grams). The area could be much larger considering that the surface of the outer oxidizable area is not uniform but has a topography of "mountains and valleys". Theoretically, because of steric repulsion and geometry, the surfactant will cover at best eighty percent (80%) to ninety percent (90%) of the outer oxidizable area of the particles. There is about three (3) to six (6) square meters of uncovered outer oxidizable area in contact with a very small amount of oil (0.55 grams). This simple calculation shows that the major oxidation effect of the oil and surfactant is due to the immense surface of oxide from the uncovered surface area of the magnetic particles.

The present invention uses a surface modifier to cover the area not covered by the surfactant used in the preparation of the magnetic fluid. The present invention requires the surface modifier to have a very low molecular weight and not to be a dispersant so it can penetrate through the tails of the existing surfactant to cover the free area of the particles uncovered by the existing surfactant.

The surface modifier has to be of a very small molecular weight and size in order to be able to penetrate the uncovered oxidizable surface of the magnetic particles through the tail of the surfactants already connected to that surface, to attach and cover the surface, and to protect the surface against oxidation.

The surface modifier employed by the present invention consists of one (1) to three (3) similar functional groups, at one end of the molecule, and a very short tail of one (1) to ten (10) atoms. The modifier can be represented by the formula $$R^1_n\ Si\ R^2_{4-n}$$

wherein the group $R^1$ denotes a hydrolyzable radical chosen from the group consisting of alkoxides of one to three carbon atoms; $R^2$ denotes an alkyl radical having one (1) to ten (10) carbon atoms; and n is 1, 2 or 3 on the average. In particular, isobutyltrimethoxy silane has been found to be a particularly useful surface treatment agent employable in the present invention and is represented by the above formula where $R^1$ denotes a methoxyradical, $R^2$ denotes the isobutyl radical and n is three. The mechanism of coupling to the free oxidizable surface by the silane is thought to be: the alkoxy part of the surface modifier reacts with the proton from the inorganic hydroxyl group to form alcohol as a byproduct, and the silicon connects to the oxygen from the former hydroxyl group present on the outer layer of the magnetic particles.

During the reaction with the surface, the surface modifier becomes even smaller because approximately one third (⅓) of the molecule is eliminated as a byproduct of this reaction.

There are several other ways to improve the chemical stability of the magnetic fluid such as adding a proper amount of antioxidant, choosing a good combination of a surfactant(s) and an oil carrier(s), having a substantially uniform particle size closer to one hundred (100) angstroms, etc. After all these options have been carefully considered, further improvement to chemical oxidation of the magnetic fluid can be achieved by adding isobutyltrimethoxysilane or other small molecules with the same capability to cover the magnetic particles.

EXAMPLE 1

13.0 g of ferrous sulfate heptahydrate and 24.0 g of ferric chloride hexahydrate were dissolved in water and the total amount of the solution was adjusted to be 70 cc with water. 30 cc op 28% ammonia solution was added to the iron salt solution and $Fe_3O_4$ particles were precipitated.

Oleic soap that consisted of 2.1 g of oleic acid and 27 cc of 3% ammonia solution was also prepared. The oleic soap was then added to the $Fe_3O_4$ particle slurry and the particles were covered with an oleic ion. 30 cc of heptane was poured into the oleic covered particle slurry, and the entire slurry was stirred and left to set. The oleic coated particles were peptised in heptane and the heptane base magnetic fluid was siphoned into a 200 cc beaker.

The oleic covered magnetite particles were flocculated with 50 cc of acetone and the supernatant was removed. The particles were washed four (4) times with 50 cc of acetone. 75 cc of water and 15 cc of a 28% ammonia solution were added into the beaker and the particles were suspended by gentle agitation, e.g. about 60 rpm. The slurry was heated up to 70° C., and 11 cc of isobutyl trimethoxysilane was added, and the slurry temperature was maintained at about 75°±5° C. for 30 minutes. After cooling the slurry, the supernatant was removed and the particles were washed five (5) times with 50 cc of acetone.

Then the washed particles were dispersed in heptane, and 20 cc of 2 cSt at 100° C. of polyalphaolefin oil was added to the heptane base magnetic fluid, the heptane was removed by heating it, and the saturation magnetization of the oil base magnetic fluid was adjusted to be 200 gauss by adding oil.

Magnetic fluid, sample #1-1, that was 200 gauss and 2 cSt oil base was obtained. Another magnetic fluid, sample #1-2, that was 200 gauss and 2 cSt oil base was prepared in the same manner as the sample #1-1 except that isobutyl trimethoxysilane was not applied to the particles during the process.

The magnetic fluids samples #1-1 and #1-2, respectively, were placed in a glass dish having an inside diameter of 12.9 mm, an outside diameter of 15.0 mm, and a length of 10 mm. The thickness of the magnetic fluid in the glass dish was 3 mm. The glass dishes were placed in a hole drilled in an aluminum plate (110 mm×110mm×10 mm), the hole being sized such that the glass dish would fit snugly. The aluminum plate was then placed on an aluminum block (220 mm×220 mm×20 mm) in an oven at a controlled temperature. A test was carried out at 80° C. and the result is shown in table 1.

TABLE 1

Gel time test result for the samples #1-1 and #1-2.

| Type of magnetic fluid | Gel time at 80° C. (hours) |
|---|---|
| Sample #1-1 | 82–91 |
| Sample #1-2 | 42–51 |

EXAMPLE 2

The oleic covered and isobutyl trimethoxysilane treated heptane base magnetic fluid was prepared in the same manner as described in Example 1.

7 cc of polyisobutenylsuccinimide and 13 cc of 6 cSt at 100° C. oil of polyalphaolefin was added into the heptane base magnetic fluid, the heptane was removed by heating it, and the saturation magnetization of the oil base fluid was adjusted to be 200 gauss by adding the oil. A magnetic fluid, sample #2-1, that was 200 gauss and 6 cSt oil base was obtained.

Another magnetic fluid, sample #2-2, that was 200 gauss and 6 cSt oil base was prepared in the same manner as the sample #2-1, except that isobutyl trimethoxysilane was not applied to the particles during the process.

A gel time test was carried out in the same manner as described in Example 1 for the samples #2-1 and #2-2, but the test temperature was raised to 150° C. Table 2 shows the test results.

TABLE 2

Gel time test result for the samples #2-1 and #2-2.

| Type of magnetic fluid | Gel time at 150° C. (hours) |
|---|---|
| Sample #2-1 | 101–130 |
| Sample #2-2 | 94–101 |

In summary, the present invention relates to a chemically stable magnetic fluid composition comprising:

1 to 40 parts by volume of magnetic particles;

1 to about 30 parts by volume of at least one surfactant;

10 to about 90 parts by volume of an organic carrier fluid; and 1 to about 25 parts by volume of a surface modifier as an additive to improve the chemical oxidation of said composition.

The surfactant is chosen from the class of surfactants consisting of cationic surfactants, anionic surfactants and nonionic surfactants and has a molecular weight of at least 150 and the carrier fluid is an organic molecule which is compatible with the surfactants.

The invention also includes a process for preparing an improved chemically stable magnetic fluid comprising a plurality of magnetic particles, at least one surfactant, an organic carrier fluid, and a surface modifier as an additive to improve the chemical oxidation of said composition, said process comprising the steps of:

preparing a solvent base magnetic fluid containing at least one of a cationic, an anionic or a nonionic surfactant, where said surfactant is connected to the outer surface of the magnetic particles, of the fluid, in order to disperse the particles in a compatible solvent base;

adding a low molecular weight surface modifier to cover exposed area of the outer layer of the magnetic particle previously uncovered by the surfactant wherein said modifier is represented by the formula $$R^1_n \, Si \, R^2_{4-n}$$

wherein the group $R^1$ denotes a hydrolyzable radical chosen from the group consisting of alkoxides of one to three carbon atoms; $R^2$ denotes an alkyl radical having one to ten carbon atoms; and n is 1, 2 or 3 on the average; and adding a high molecular weight organic carrier and evaporating the solvent carrier by increasing the temperature of the mixture to evaporate the solvent carrier and to disperse the magnetic particles in the carrier fluid.

What is claimed is:

1. A chemically stable magnetic fluid composition comprising:

1 to 40 parts by volume of magnetic particles;

1 to about 30 parts by volume of at least one surfactant;

10 to about 90 parts by volume of an organic carrier fluid; and 1 to about 25 parts by volume of a silane base surface modifier as an additive to improve the chemical oxidation of said composition.

2. The composition according to claim 1, wherein said additive is a surface modifier represented by the formula $$R^1_n \, Si \, R^2_{4-n}$$

wherein the group $R^1$ denotes a hydrolyzable radical chosen from the group consisting of alkoxides of one to three carbon atoms; $R^2$ denotes an alkyl radical having one to ten carbon atoms; and n is 1, 2 or 3 on the average.

3. The composition according to claim 1 wherein said silane base surface modifier is isobutyl trimethoxysilane.

4. The composition according to claim 1 wherein said magnetic particles are ferrite which have a diameter size ranging from about thirty (30) to about one hundred fifty (150) angstroms.

5. The composition according to claim 1 wherein said surfactant is chosen from the class of surfactants consisting of cationic surfactants, anionic surfactants and nonionic surfactants and has a molecular weight of at least 150.

6. The composition according to claim 1, wherein said silane base surface modifier is an alkyl alkoxy silane surface modifier.

7. The composition according to claim 1, wherein said carrier fluid is an organic molecule compatible with at least one surfactant.

8. A process for preparing an improved chemically stable magnetic fluid comprising a plurality of magnetic particles, at least one surfactant, an organic carrier fluid, and a surface modifier as an additive to improve the chemical oxidation of said composition, said process comprising the steps of:

preparing a solvent base magnetic fluid containing at least one of a cationic, an anionic or a nonionic surfactant where said surfactant is connected to the outer surface of the magnetic particles of the fluid, in order to disperse the particles in a compatible solvent base;

adding a low molecular weight surface modifier to improve the chemical oxidation of said composition wherein said modifier is represented by the formula $$R^1_n \, Si \, R^2_{4-n}$$

wherein the group $R^1$ denotes a hydrolyzable radical chosen from the group consisting of alkoxides of one to three carbon atoms; $R^2$ denotes an alkyl radical having one to ten carbon atoms; and n is 1, 2, or 3 on the average; and adding a high molecular weight organic carrier and evaporating the solvent carrier by increasing the temperature of the mixture to evaporate the solvent carrier and to disperse the magnetic particles in the carrier fluid.

* * * * *